US010604378B2

(12) United States Patent
Murah et al.

(10) Patent No.: US 10,604,378 B2
(45) Date of Patent: Mar. 31, 2020

(54) EMERGENCY ELEVATOR POWER MANAGEMENT

(71) Applicant: OTIS ELEVATOR COMPANY, Farmington, CT (US)

(72) Inventors: Bennie J. Murah, Timmonsville, SC (US); Tarique Faruki, Florence, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 348 days.

(21) Appl. No.: 15/622,433

(22) Filed: Jun. 14, 2017

(65) Prior Publication Data

US 2018/0362289 A1 Dec. 20, 2018

(51) Int. Cl.
*B66B 1/28* (2006.01)
*B66B 5/02* (2006.01)
(Continued)

(52) U.S. Cl.
CPC ..... *B66B 1/28* (2013.01); *B66B 1/30* (2013.01); *B66B 1/302* (2013.01); *B66B 1/32* (2013.01);
(Continued)

(58) Field of Classification Search
CPC ..... B66B 1/28; B66B 1/302; B66B 5/021; B66B 1/30; B66B 1/32; B66B 1/2458; B66B 2201/216; B66B 2201/301
(Continued)

(56) References Cited

U.S. PATENT DOCUMENTS 4,042,069 A * 8/1977 Ohira ..... H02P 5/747 187/296
6,315,081 B1 11/2001 Yeo
(Continued)

FOREIGN PATENT DOCUMENTS

CN 1311152 A 9/2001
CN 103508280 A 1/2014
(Continued)

OTHER PUBLICATIONS

US 8,584,807 B2, 11/2013, Veronesi (withdrawn)
(Continued)

*Primary Examiner* — Jeffrey Donels
(74) *Attorney, Agent, or Firm* — Carlson, Gaskey & Olds

(57) ABSTRACT

An illustrative example embodiment of an elevator system includes: a plurality of elevator cars; a plurality of elevator machines, respectively associated with the elevator cars to selectively cause movement of the associated elevator car, at least some of the elevator machines respectively operating in a first mode including consuming power and in a second mode including generating power; a power source having a power output threshold and a power intake threshold; and at least one controller that is configured to determine when the power source is providing power for the elevator system, and dynamically adjust how the plurality of machines move the elevator cars to maximize a number of the plurality cars being used to move passengers while keeping power consumption by the elevator system below the power output threshold and keeping power generation by the elevator system below the power intake threshold.

20 Claims, 2 Drawing Sheets

(51) Int. Cl.
*B66B 1/32* (2006.01)
*B66B 1/30* (2006.01)
*B66B 1/24* (2006.01)

(52) U.S. Cl.
CPC ..... *B66B 5/021* (2013.01); *B66B 1/2458* (2013.01); *B66B 2201/216* (2013.01); *B66B 2201/301* (2013.01)

(58) Field of Classification Search
USPC ..... 187/241
See application file for complete search history.

(56) References Cited

U.S. PATENT DOCUMENTS

| | | | |
|---|---|---|---|
| 6,431,323 | B2 | 8/2002 | Tajima et al. |
| 6,435,313 | B2 | 8/2002 | Tajima et al. |
| 6,439,347 | B2 | 8/2002 | Suga et al. |
| 6,439,348 | B2 | 8/2002 | Tajima et al. |
| 6,471,013 | B2 | 10/2002 | Banno et al. |
| 6,533,074 | B2 | 3/2003 | Tominaga et al. |
| 6,732,838 | B1 | 5/2004 | Okada et al. |
| 6,827,182 | B2 | 12/2004 | Araki |
| 7,540,355 | B2 | 6/2009 | Harkonen |
| 7,540,356 | B2 | 6/2009 | Smith et al. |
| 7,743,890 | B2 | 6/2010 | Nikovski et al. |
| 7,909,143 | B2 | 3/2011 | Tyni et al. |
| 8,083,033 | B2 | 12/2011 | Kallioniemi et al. |
| 8,172,042 | B2 | 5/2012 | Wesson et al. |
| 8,177,032 | B2 | 5/2012 | Hashimoto |
| 8,602,172 | B2 | 12/2013 | Suzuki et al. |
| 8,616,338 | B2 | 12/2013 | Veronesi et al. |
| 8,631,908 | B2 | 1/2014 | Schroeder-Brumloop et al. |
| 8,794,388 | B2 | 8/2014 | Takeda |
| 8,997,940 | B2 | 4/2015 | Villa |
| 9,315,361 | B2 | 4/2016 | Eto |
| 9,481,549 | B2 | 11/2016 | Ishiguro |
| 2007/0084673 | A1 | 4/2007 | Smith et al. |
| 2011/0144810 | A1 | 6/2011 | Wesson et al. |
| 2013/0056312 | A1* | 3/2013 | Finschi ..... B66B 25/00 187/382 |
| 2014/0284145 | A1 | 9/2014 | Finschi |
| 2015/0136531 | A1* | 5/2015 | Rogers ..... B66B 1/30 187/290 |
| 2018/0134519 | A1* | 5/2018 | Kattainen ..... B66B 5/027 |
| 2018/0186595 | A1* | 7/2018 | Krishnamurthy ..... B66B 1/2458 |
| 2018/0312370 | A1* | 11/2018 | Saarelainen ..... B66B 1/32 |
| 2018/0327215 | A1* | 11/2018 | Kattainen ..... B66B 1/308 |
| 2019/0067981 | A1* | 2/2019 | Saarela ..... H02J 7/14 |

FOREIGN PATENT DOCUMENTS

| | | | |
|---|---|---|---|
| CN | 103596868 | A | 2/2014 |
| CN | 103663011 | A | 3/2014 |
| CN | 104058307 | A | 9/2014 |
| CN | 104080723 | A | 10/2014 |
| EP | 2597061 | A1 | 5/2013 |
| JP | 2009215005 | | 9/2009 |
| JP | 2015020859 | A | 2/2015 |
| WO | 96/16892 | | 6/1996 |
| WO | 2007/044000 | A1 | 4/2007 |
| WO | 2009/154618 | A1 | 12/2009 |

OTHER PUBLICATIONS

Office Action for Korean Patent Application No. 10-2018-0063377 dated Jun. 20, 2019.

Extended European Search Report for Application No. EP 18 17 7301 dated Dec. 10, 2018.

* cited by examiner

EMERGENCY ELEVATOR POWER MANAGEMENT

BACKGROUND

Elevator systems are useful for carrying passengers among different levels in a building. Typical traction-based elevator systems include elevator cars and counterweights associated with respective machines responsible for moving the elevator car. Some elevator machines are capable of operating in two different modes. In a motoring or power consumption mode, the machine draws power from a utility grid or emergency generators, for example, while starting movement of the elevator car or lifting a positive load. In a power regeneration or "regen" mode, the machine operates as an electrical generator generating electricity that can be provided back into the utility grid, emergency generators or an energy storage device. The regeneration mode may occur, for example, when stopping a moving car or lifting a negative load based on movement of the elevator car under appropriate conditions.

Many elevator systems include a backup power source to allow elevator system operation even when a primary power supply becomes unavailable, such as during a utility power outage. The amount of power drawn by a typical elevator system requires a substantial backup power supply. Many existing elevator systems include a restriction or limitation on the number of elevator cars that can be in service when the backup power supply is in use. For example, some elevator systems will only allow one car to be in service under those conditions. The Occupant Evacuation Operation (OEO) protocol requires sufficient back up power to supply all the Occupant Evacuation Elevators (OEEs) in a building. One approach to satisfying OEO requirements would be to include multiple, large-capacity emergency generators, but that introduces significant cost.

SUMMARY

An illustrative example embodiment of an elevator system includes: a plurality of elevator cars; a plurality of elevator machines, respectively associated with the elevator cars to selectively cause movement of the associated elevator car, at least some of the elevator machines respectively operating in a first mode including consuming power and in a second mode including generating power; a power source that provides power for elevator car movement, the power source having a power output threshold and a power intake threshold; and at least one controller that is configured to determine when the power source is providing power for the elevator system, and dynamically adjust how the plurality of machines move the elevator cars to maximize a number of the plurality cars being used to move passengers while keeping power consumption by the elevator system below the power output threshold and keeping power generation by the elevator system below the power intake threshold.

In an example embodiment having one or more features of the elevator system of the previous paragraph, the controller dynamically adjusts how the plurality of machines move the elevator cars to maximize the number of the plurality of cars being used to move passengers during an occupant evacuation operation.

In an example embodiment having one or more features of the elevator system of any of the previous paragraphs, the controller controls timing of one or more power spike events to minimize a number of power spike events within a predetermined time interval.

In an example embodiment having one or more features of the elevator system of any of the previous paragraphs, the power spike events include acceleration of an elevator car, starting movement of an elevator car from a stop, and stopping an elevator car that is moving in a manner that the associated elevator machine generates power.

In an example embodiment having one or more features of the elevator system of any of the previous paragraphs, the controller controls the timing to avoid more than one power spike event simultaneously.

In an example embodiment having one or more features of the elevator system of any of the previous paragraphs, the controller dynamically adjusts how the plurality of machines move the elevator cars by controlling a timing of at least one of elevator car starts from stop, elevator car stops, elevator car speed, elevator car acceleration, and elevator car deceleration.

In an example embodiment having one or more features of the elevator system of any of the previous paragraphs, the controller dynamically adjusts how the plurality of machines move the elevator cars by scheduling at least one of the elevator machines to operate in the first mode while at least one other of the elevator machines operates in the second mode.

In an example embodiment having one or more features of the elevator system of any of the previous paragraphs, the controller schedules movement of the plurality of elevator cars to maximize a number of passengers brought to a predetermined destination per unit of time.

In an example embodiment having one or more features of the elevator system of any of the previous paragraphs, the predetermined destination corresponds to a location where the passengers can exit a building in which the elevator system is situated.

In an example embodiment having one or more features of the elevator system of any of the previous paragraphs, the controller balances an amount of power consumed by any of the elevator machines operating in the first mode with an amount of power generated by any of the elevator machines operating in the second mode during a time interval.

An illustrative example embodiment of a method of operating an elevator system includes determining when a power source is providing power for the elevator system and dynamically adjusting how a plurality of machines move a plurality of associated elevator cars to maximize a number of the plurality of cars being used to move passengers while keeping power consumption by the elevator system below the power output threshold of the power source and keeping power generation by the elevator system below the power intake threshold of the power source.

An example embodiment having one or more features of the method of the previous paragraph includes dynamically adjusting how the plurality of machines move the elevator cars to maximize the number of the plurality of cars being used to move passengers during an occupant evacuation operation.

An example embodiment having one or more features of the method of any of the previous paragraphs includes controlling timing of one or more power spike events to minimize a number of power spike events within a predetermined time interval.

In an example embodiment having one or more features of the method of any of the previous paragraphs, the power spike events include acceleration of an elevator car, starting movement of an elevator car from a stop, and stopping an elevator car that is moving in a manner that the associated elevator machine generates power.

An example embodiment having one or more features of the method of any of the previous paragraphs includes controlling the timing to avoid more than one power spike event simultaneously.

An example embodiment having one or more features of the method of any of the previous paragraphs includes dynamically adjusting how the plurality of machines move the elevator cars by controlling a timing of at least one of elevator car starts from stop, elevator car stops, elevator car speed, elevator car acceleration, and elevator car deceleration.

An example embodiment having one or more features of the method of any of the previous paragraphs includes dynamically adjusting how the plurality of machines move the elevator cars by scheduling at least one of the elevator machines to operate in a power consumption mode while at least one other of the elevator machines operates in a power regeneration mode.

An example embodiment having one or more features of the method of any of the previous paragraphs includes scheduling movement of the plurality of elevator cars to maximize the number of passengers brought to a predetermined destination per unit of time.

In an example embodiment having one or more features of the method of any of the previous paragraphs, the predetermined destination corresponds to a location where the passengers can exit a building in which the elevator system is situated.

An example embodiment having one or more features of the method of any of the previous paragraphs includes balancing an amount of power consumed by any of the elevator machines operating in a power consumption mode with an amount of power generated by any of the elevator machines operating in a power regenerative mode during a time interval.

The various features and advantages of at least one disclosed example embodiment will become apparent to those skilled in the art from the following detailed description. The drawing that accompanies the detailed description can be briefly described as follows.

DETAILED DESCRIPTION

Example embodiments of this invention facilitate maximizing a number of elevator cars that can be used for moving passengers within the power limits of a power source for the elevators. Embodiments of this invention are particularly suited for controlling elevator system operation in situations that require emergency or backup power for operating the elevator system. The manner in which elevator machines move the elevator cars is dynamically adjusted to maximize the number of cars being used while keeping power limits within the capacity of the backup power source. Predicting, monitoring, and controlling the motoring and regen power of an elevator system according to an embodiment of this invention allows for keeping the peak motoring and regen power of the elevator system within desired limits while maximizing a number of elevator cars that can be used during an Occupant Evacuation Operation (OEO).

Figure 1:
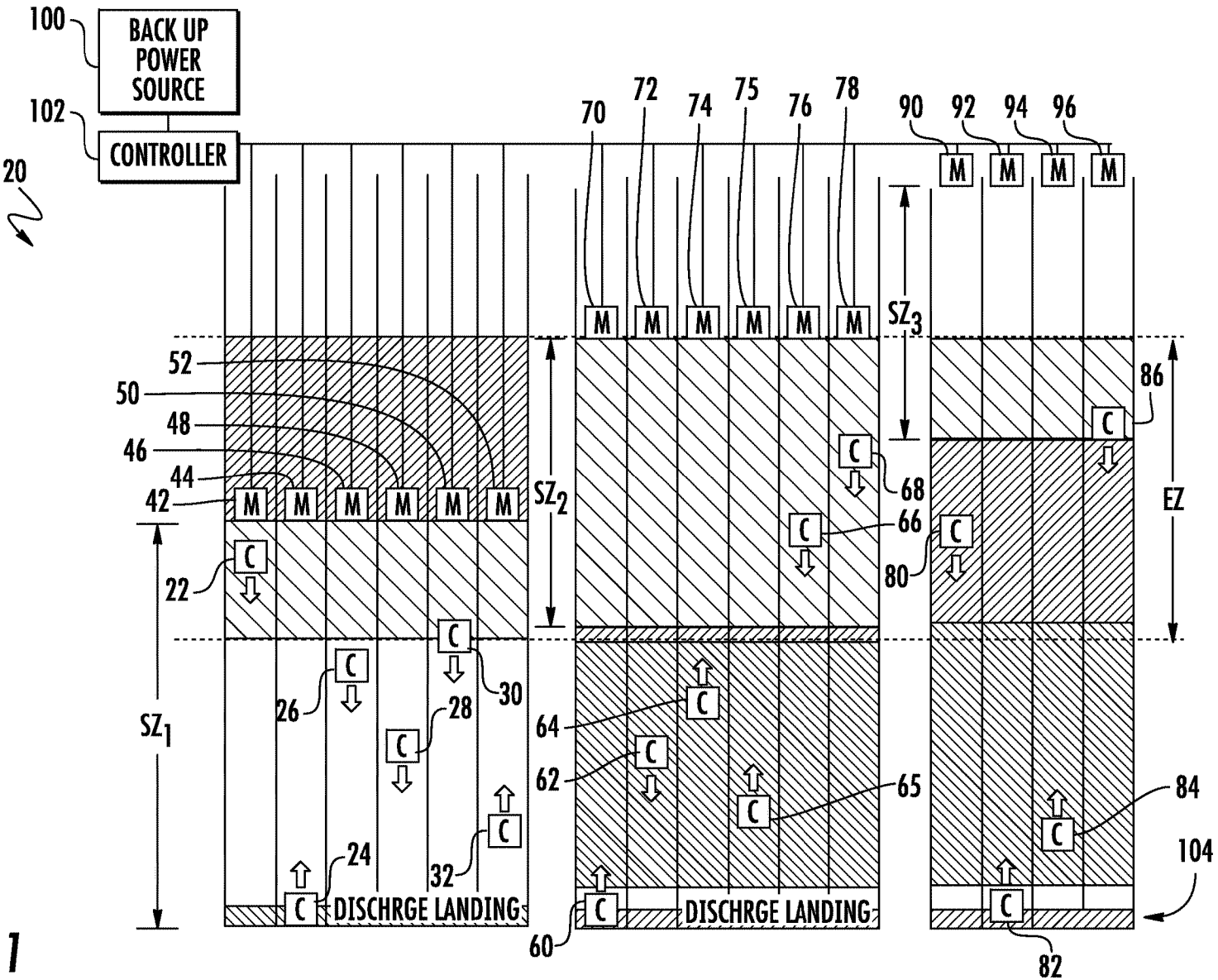
FIG. 1 schematically illustrates selected portions of an elevator system designed according to an embodiment of this invention.

FIG. 1 schematically illustrates selected portions of an elevator system 20 within a building. A plurality of elevator cars are situated within respective hoistways. For purposes of discussion, sixteen elevator cars and associated machines are illustrated. Other details of the illustrated example elevator system, such as the counterweight and roping arrangement, are not shown as those aspects of an elevator system are understood by those skilled in the art and need not be illustrated to gain an understanding of embodiments of this invention. Elevator systems designed according to an embodiment of this invention may include more or fewer cars.

Although the illustrated elevator system is a traction-based elevator system, other elevator system configurations that do not require a counterweight or roping are included in some embodiments. In such embodiments, the machine will not be a traction machine but will include some source of motive power, such as a motor, for moving the associated elevator car when needed and a brake for controlling movement and position of the associated elevator car. For discussion purposes, a traction based elevator system is used as an example system in the remainder of this description. Those skilled in the art who have the benefit of this description will be able to apply the features of this invention to other elevator system configurations.

The illustrated example in FIG. 1 includes a group of elevator cars that are dedicated to servicing a zone of floors indicated as $SZ_1$ in FIG. 1. The elevators that service the floors in $SZ_1$ include cars 22, 24, 26, 28, 30 and 32. Each of those cars has a respective machine 42, 44, 46, 48, 50 and 52.

A second group of elevator cars 60, 62, 64, 65, 66 and 68 are dedicated to servicing floors through a mid-section of the building. The service zone of the second group of cars is indicated at $SZ_2$ in FIG. 1. The cars 60-68 have respective machines 70, 72, 74, 75, 76 and 78.

A third group of elevator cars 80, 82, 84 and 86 and their associated machines 90, 92, 94 and 96, respectively, are dedicated to servicing a group of floors near the top of the example building. The service zone $SZ_3$ includes the only floors serviced by the elevator cars 80-86.

In the illustrated embodiment, each of the elevator machines is capable of operating in two different modes. A first mode or motoring mode includes consuming power during a first type of elevator car movement. For example, when the elevator machine is moving the associated elevator car in a manner that requires drawing power from a power source, the elevator machine operates in the first mode because it is consuming power under those conditions. Given that a counterweight is typically designed with a mass that is approximately equal to the mass of the elevator car plus between forty-five and fifty-five percent of the rated duty load of the car, there are times when the counterweight is heavier than the car and lowering the elevator car under those circumstances requires power to lift the counterweight. Alternatively, when the car is loaded sufficiently to be heavier than the counterweight, power is required to raise the elevator car. Depending on the elevator car acceleration, there are situations in which motoring power (i.e., power consumption) is required to start moving a heavily loaded car down or an empty car up. These and other power consumption conditions are accounted for when determining power consumption by a particular machine or set of machines.

Each of the elevator machines in the illustrated example is capable of operating in a second mode that includes generating power during a second type of elevator car movement. This second mode may be referred to as a regenerative or regen mode. For example, when an elevator car is fully loaded and traveling downward, the elevator machine associated with that car does not need to draw power from a power source to accomplish such movement. Instead, the elevator machine may operate in a regenerative mode during which the elevator machine operates like an electrical generator and provides power back to a power source, such as a utility grid or emergency generator, or otherwise to an energy storage device. For example, raising an empty car does not require drawing power because the counterweight, which is heavier than an empty car, will descend as allowed by the machine. Another circumstance in which a machine operates in the second or regen mode is lowering a fully loaded car, which is heavier than the associated counterweight. Depending on the elevator car deceleration, there are situations in which the machine generates a small amount of regen power when slowing a heavily loaded car moving up or an empty car down. Such effects are accounted for when determining the total regen power of the elevator system.

The elevator system includes an emergency or backup power source 100 that is useful for providing power to the plurality of elevator machines during a situation in which a main power supply (not illustrated) is unavailable. The backup power source 100 has a power output threshold corresponding to a maximum power capacity of the backup power source 100. In this example, the backup power source 100 also has a power intake threshold that corresponds to a maximum amount of power that can be taken in by or received by the backup power source 100 from the elevator machines that are operating in a regenerative mode.

A controller 102 controls operation of the elevator system 20 when the backup power source 100 is in use. The controller 102 includes at least one processor or computing device and associated memory. The controller 102 is schematically shown as a single device or component, however, the features and functions of the controller 102 may be realized through multiple devices. Additionally, the controller 102 may be a dedicated device or may be realized through portions of multiple other controllers associated with an elevator system. Those skilled in the art who have the benefit of this description will realize how to arrange components to achieve a controller 102 that meets their particular needs. Additionally, those skilled in the art who have the benefit of this description will be able to suitably program a controller to function according to an embodiment of this invention.

The processor or computing device is programmed such that the controller 102 is configured to dynamically adjust the manner in which the elevator machines cause movement of the respective elevator cars to ensure that the power thresholds of the backup power source 100 are not exceeded while maximizing a number of elevator cars that can be used for carrying passengers when the backup power source 100 is in use.

One situation in which the example elevator system 20 is useful is during OEO, which may correspond to an emergency evacuation situation in which people should be evacuated from at least some floors of the building where the elevator system 20 is located. In some embodiments the controller 102 schedules or controls movement of the elevator cars to maximize a number of passengers brought to a predetermined destination per unit of time. In some example embodiments, all of the elevator cars of the elevator system 20 may be used during OEO without exceeding the power thresholds of the backup power source 100. For example, all elevators may be utilized where all traffic is in a downward direction with fully loaded cars. The controller 102 utilizes information regarding the power requirements of each elevator machine and its associated elevator car and dynamically adjusts operation of the elevator machines as needed to ensure that the power thresholds of the backup power source 100 are not exceeded. The technique used in the illustrated example embodiment allows for relatively lower-cost backup power sources to be sufficient for enabling movement of most or all elevator cars of an elevator system without requiring multiple or expensive backup power sources.

During an occupant evacuation operation, most passenger traffic will be from upper levels of a building down to a lobby, ground level, or some lower exit level so the individual passengers can exit the building. When an elevator car is sufficiently loaded, such downward movement will typically be associated with an elevator machine operating in a regenerative mode. In the illustrated example, the elevator machines would operate in the second mode that includes generating power during that type of elevator car movement. Also, sending an empty car upward to gather more passengers allows the associated machine to operate in the second, regenerative mode because the counterweight (not illustrated) is heavier than the car and the counterweight is descending in that situation. It follows that the power intake threshold of the backup power source 100 is more likely to be exceeded than the power output threshold during an occupant evacuation operation. The controller 102 controls operation of the elevator machines in a way that reduces the likelihood of or eliminates the possibility of exceeding that power intake threshold.

There are various aspects of elevator car movement that are associated with different levels of power consumption or regeneration. For example, when an elevator car is loaded at approximately eighty percent or greater of its rated capacity, downward movement will result in regenerative power from the associated machine. There tends to be a spike of such power when such an elevator car reaches the end of travel and stops at a landing. Large spikes in power consumption tend to occur when an elevator car begins movement.

As schematically represented in FIG. 1, several of the floors within the building serviced by the elevator system 20 are part of an evacuation zone EZ. One or more of the floors within the evacuation zone EZ includes a hazardous condition, such as a fire, that requires evacuating individuals from at least the floors in the EZ zone.

As can be appreciated from FIG. 1 by comparing the different service zones SZ with the evacuation zone EZ, none of the groups of elevator cars is capable of performing OEO for the entire evacuation zone EZ. The elevator cars 22-32 are only capable of servicing a lower portion of the evacuation zone, the elevator cars 80-86 are only capable of serving an upper portion of the evacuation zone, and the elevator cars that are dedicated to the service zone $SZ_2$ are capable of servicing all but one or a few of the lower floors within the evacuation zone EZ. Under the circumstances schematically shown in FIG. 1, all three groups of elevator cars may be used during OEO.

The controller 102 controls movement of the elevator cars to ensure that the power consumption of the elevator system 20, which is associated with elevator machines operating in the first or motoring mode, and power regeneration, which is associated with machines operating in the second or regenerative mode, do not exceed the corresponding limits of the backup power source 100. The controller 102 is configured or programmed to account for the various ways in which elevator car movement or machine operation affect the power consumed or generated by the elevator system.

Figure 2:
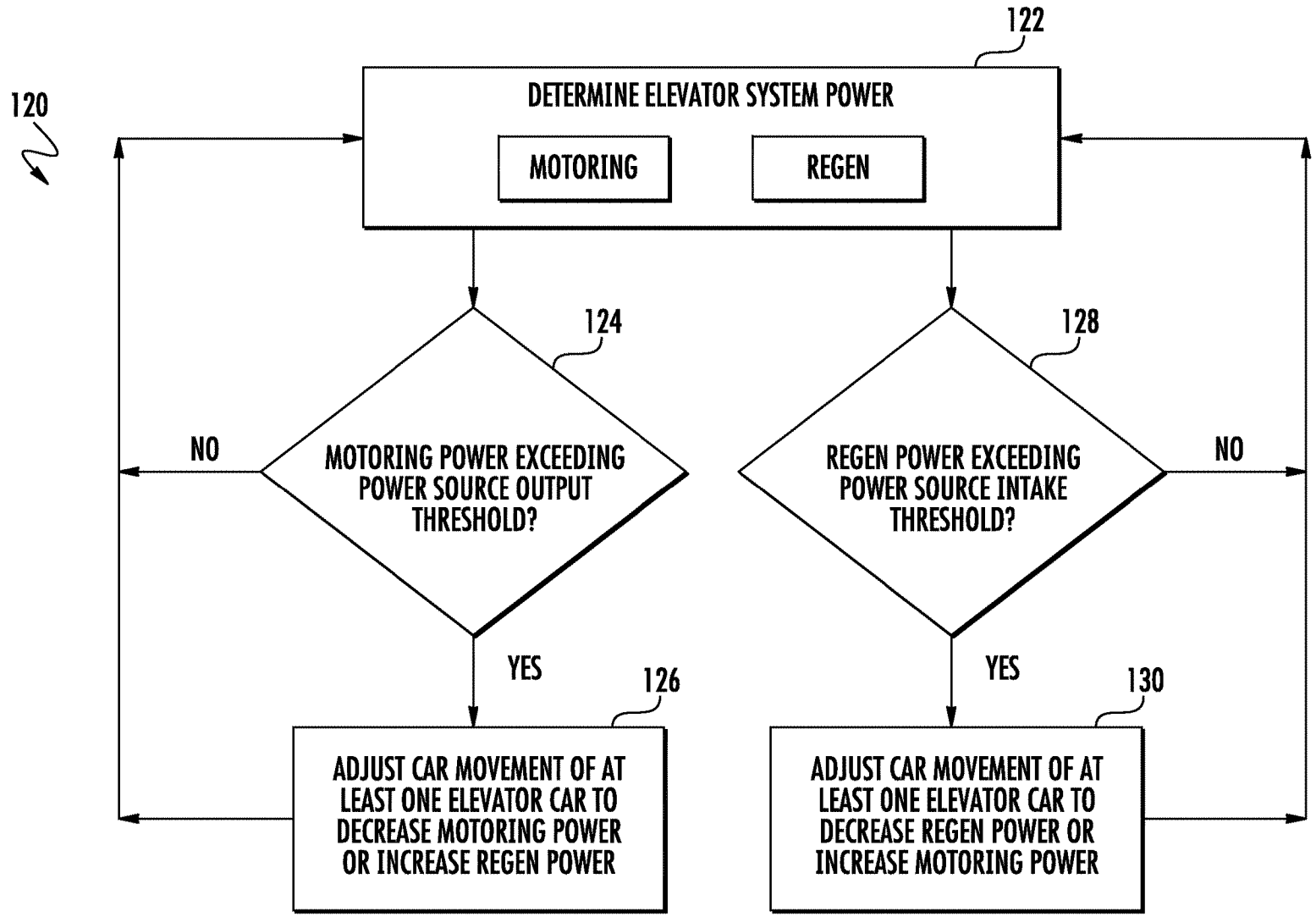
FIG. 2 is a flow chart diagram summarizing an example control strategy designed according to an embodiment of this invention.

FIG. 2 is a flowchart diagram 120 summarizing an example approach used by the controller 102. At 122 the controller 102 determines the power of the elevator system including the amount of power consumed by the system and the amount of regenerative power generated by the system. Each machine individually contributes to the total motoring and regen power depending on the current state of machine operation. The controller 102 continuously determines the total power of the elevator system as a present power level and a predicted level to proactively control the power to be within the threshold limits of the power source.

At 124, the controller 102 determines whether the motoring power exceed the power source output threshold. If not, then the controller 102 continues monitoring power at 122. If the motoring power is or will exceed the output threshold at 124 then the controller adjusts car movement (e.g., changes timing of a start or stop, changes acceleration rate or changes speed) to decrease motoring power or increase regen power to bring the total system power within the desired limits.

At 128, the controller 102 determines the system regen power. If that power level is acceptable, then the controller 102 continues monitoring and predicting power at 122. If the regen power is outside or predicted to be outside the limit corresponding to the power intake threshold of the backup power source, then the controller 102 adjusts car movement of at least one elevator car to bring down the regen power or to increases the motoring power for using some of the regen power so that the intake threshold of the backup power source will not be exceeded.

The controller 102 is programmed or otherwise has information available to it that indicates which of the floors within the evacuation zone EZ can be serviced by which of the elevator cars or groups of cars. That information allows the controller 102 to assess a likelihood of any stops of any of the elevator cars, which may impact the power consumption or power regeneration of the elevator system 20. For example, the controller 102 need not account for any possible stops by any of the elevator cars within the second group that are dedicated to the service zone $SZ_2$ outside of that zone while conducting OEO to evacuate individuals from the evacuation zone EZ. Additionally, during OEO, once passengers board the elevator car the car will only move toward the discharge landing and no calls outside the evacuation zone will be serviced. Such factors are taken into account when determining and predicting power levels.

In FIG. 1, the elevator car 22 is only partially loaded and descending. The machine 42 is, therefore, operating in a power consumption or motoring mode for purposes of returning the car 22 to a lobby or discharge landing at a level 104 in the building. The elevator car 24 is currently moving upward with the machine 44 operating in the first or motoring mode. The elevator car 26 is loaded such that it is heavier than its associated counterweight (not illustrated) such that the machine 46 is operating in the second or regen mode. The machine 48 is also operating in a regen mode as the elevator car 28 descends. The elevator car 30 is lightly loaded such that the machine 50 is operating in the first mode for purposes of lowering the elevator car 30. The elevator car 32 is loaded such that the machine 52 operates in the first mode for purposes of raising the elevator car 32. In this example, the controller 102 causes the machine 52 to operate at a reduced speed compared to a contract or design speed to reduce the amount of power consumption for at least a portion of that run of the elevator car 32.

Others of the machines are operating in the first or power consumption mode while still others are operating in the second or regen mode. For purposes of discussion, the machines 70, 78 and 96 are operating in the first mode while the machines 72, 74, 75, 76, 90 and 94 are all operating in the second mode. At the instance schematically shown in FIG. 1, the elevator car 82 is currently stopped and the next run of that car is delayed by the controller 102 to temporarily avoid introducing the additional power consumption that will be associated with the machine 92 initiating movement of the elevator car 82.

Given the amount of power consumption and power regeneration by the various machines, the controller 102 is able to balance out the amount of power consumption and the amount of power regeneration to avoid exceeding the output threshold of the backup power source 100 and the intake threshold of the backup power source 100.

In the illustrated example, the elevator system 20 is configured so that regenerative power from any of the machines is provided to the backup power source 100 to recharge or replenish the power output capacity of the backup power source 100. The controller 102 dynamically adjusts operation of the elevator machines that are operating in the second mode including regenerative power production by controlling, for example, a timing of the beginning of such movement, speed of such movement, acceleration or deceleration of such movement, and a timing of stopping an elevator car moving in that mode. Adjusting the timing of such events allows the controller 102 to control how much regenerative power is provided to the backup source 100 at any given instance in time or during any time interval.

For example, the controller 102 controls operation of the elevator machines to ensure that the associated elevator cars do not stop at the same time to avoid having a more significant regenerative power spike that has to be absorbed by the backup power source 100. The controller 102 in this example is configured to separate the stop time of any elevator car moving in the second mode of operation to ensure some time delay between successive stops of the elevator cars. In addition to controlling the timing of elevator car stops to avoid overlap in time, the controller 102 controls timing of one or more power spike events to minimize a number of power spike events within a predetermined time interval.

Similarly, the controller 102 controls movement of any of the elevator cars moving in the motoring or first mode during which the associated machine must consume power from the backup source to avoid exceeding the power output threshold of the backup power source 100. The beginning of elevator car movement and acceleration tend to require more power consumption by the associated machine and, therefore, the controller 102 is configured or programmed to avoid simultaneous starts of multiple elevator cars and to avoid having multiple cars accelerating at the same rate at the same time. Slowing down the acceleration of one of the elevator cars may be sufficient to avoid a power consumption spike that could pose a problem for the backup power source 100, such as exceeding the power output threshold.

One feature of the example controller 102 is that it balances power consumption and power regeneration by the machines. For example, when the condition schematically shown in FIG. 1 exists and some of the elevator cars are moving in a manner that results in regenerative power produced by the associated elevator machines, the controller 102 controls the timing of the movement of those cars and at least one other elevator car moving in the first, motoring mode so that the power consumption by the elevator machine or the other car is able to utilize at least some of the regenerative power produced at that time. Coordinating the timing of elevator cars moving in the different modes (i.e., power consumption or power regeneration) facilitates ensuring that the power thresholds of the backup power source 100 will not be exceeded. At the same time, a maximum number of the elevator cars becomes available for carrying passengers while the backup power source 100 is in use.

In one example embodiment, the controller 102 determines when a level of power consumption or power regeneration is approaching the corresponding threshold of the backup power source 100. The controller 102 controls timing of an assignment for an elevator car to avoid exceeding that threshold. For example, when regenerative power that cannot otherwise be used and has to be absorbed by the backup power source 100 is approximately 90% of the power intake threshold of the backup power source 100, the controller 102 delays allowing another elevator car to move in a manner that its associated machine will provide more regenerative power until after one of the elevator cars has stopped moving in that manner or until another elevator machine begins consuming power. Given this description, those skilled in the art will realize how to program an appropriate controller to achieve the type of power management that allows for using an economical backup power source while maximizing the number of elevator cars that may be operational under conditions in which that backup power source is in use.

Although OEO operation is discussed above, the elevator system operation control described above may be useful in other situations in which a power source other than an emergency backup power source has an output limit or an intake limit. The described approach to controlling elevator system operation and car movement maximizes the number of elevator cars that can be used within such limits.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

a plurality of elevator cars;

a plurality of elevator machines, respectively associated with the elevator cars to selectively cause movement of the associated elevator car, at least some of the elevator machines respectively operating in a first mode including consuming power and in a second mode including generating power;

a power source that provides power for elevator car movement, the power source having a power output threshold corresponding to a maximum power capacity of the power source and a power intake threshold corresponding to a maximum amount of generated power that can be taken in by the power source; and at least one controller that is configured to determine when the power source is providing power for the elevator system, and dynamically adjust how the plurality of machines move the elevator cars to maximize a number of the plurality cars being used to move passengers, to keep power consumption by the elevator system below the power output threshold and to keep power generation by the elevator system below the power intake threshold.

2. The elevator system of claim 1, wherein the controller dynamically adjusts how the plurality of machines move the elevator cars to maximize the number of the plurality of cars being used to move passengers during an occupant evacuation operation.

3. The elevator system of claim 1, wherein the controller controls timing of one or more power spike events to minimize a number of power spike events within a predetermined time interval.

4. The elevator system of claim 3, wherein the power spike events include acceleration of an elevator car, starting movement of an elevator car from a stop, and stopping an elevator car that is moving in a manner that the associated elevator machine generates power.

5. The elevator system of claim 3, wherein the controller controls the timing to avoid more than one power spike event simultaneously.

6. The elevator system of claim 1, wherein the controller dynamically adjusts how the plurality of machines move the elevator cars by controlling a timing of at least one of elevator car starts from stop, elevator car stops, elevator car speed, elevator car acceleration, and elevator car deceleration.

7. The elevator system of claim 1, wherein the controller dynamically adjusts how the plurality of machines move the elevator cars by scheduling at least one of the elevator machines to operate in the first mode while at least one other of the elevator machines operates in the second mode.

8. The elevator system of claim 1, wherein the controller schedules movement of the plurality of elevator cars to maximize a number of passengers brought to a predetermined destination per unit of time.

9. The elevator system of claim 8, wherein the predetermined destination corresponds to a location where the passengers can exit a building in which the elevator system is situated.

10. The elevator system of claim 1, wherein the controller balances an amount of power consumed by any of the elevator machines operating in the first mode with an amount of power generated by any of the elevator machines operating in the second mode during a time interval.

11. A method of operating an elevator system that includes a plurality of elevator cars, a plurality of elevator machines, and a power source, wherein the elevator machines are respectively associated with the elevator cars to selectively cause movement of the associated elevator cars, wherein the power source provides power for elevator car movement, and wherein the power source has a power output threshold corresponding to a maximum power capacity of the power source and a power intake threshold corresponding to a maximum amount of generated power that can be taken in by the power source, the method comprising:

determining when the power source is providing power for the elevator system; and dynamically adjusting how the plurality of machines move the elevator cars to maximize a number of the plurality of cars being used to move passengers, to keep power consumption by the elevator system below the power output threshold and to keep power generation by the elevator system below the power intake threshold.

12. The method of claim 11, comprising dynamically adjusting how the plurality of machines move the elevator cars to maximize the number of the plurality of cars being used to move passengers during an occupant evacuation operation.

13. The method of claim 11, comprising controlling timing of one or more power spike events to minimize a number of power spike events within a predetermined time interval.

14. The method of claim 13, wherein the power spike events include acceleration of an elevator car, starting movement of an elevator car from a stop, and stopping an elevator car that is moving in a manner that the associated elevator machine generates power.

15. The method of claim 13, comprising controlling the timing to avoid more than one power spike event simultaneously.

16. The method of claim 11, comprising dynamically adjusting how the plurality of machines move the elevator cars by controlling a timing of at least one of elevator car starts from stop, elevator car stops, elevator car speed, elevator car acceleration, and elevator car deceleration.

17. The method of claim 11, comprising dynamically adjusting how the plurality of machines move the elevator cars by scheduling at least one of the elevator machines to operate in a power consumption mode while at least one other of the elevator machines operates in a power regeneration mode.

18. The method of claim 11, comprising scheduling movement of the plurality of elevator cars to maximize the number of passengers brought to a predetermined destination per unit of time.

19. The method of claim 18, wherein the predetermined destination corresponds to a location where the passengers can exit a building in which the elevator system is situated.

20. The method of claim 11, comprising balancing an amount of power consumed by any of the elevator machines operating in a power consumption mode with an amount of power generated by any of the elevator machines operating in a power regenerative mode during a time interval.

* * * * *